US010240431B2

(12) United States Patent
Caminari et al.

(10) Patent No.: US 10,240,431 B2
(45) Date of Patent: Mar. 26, 2019

(54) NESTED FLAPPER SPRING

(71) Applicant: Schlumberger Technology Corporation, Sugar Land, TX (US)

(72) Inventors: Richard T. Caminari, Rosharon, TX (US); Frank Edward Coss, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 206 days.

(21) Appl. No.: 15/208,788

(22) Filed: Jul. 13, 2016

(65) Prior Publication Data

US 2018/0016866 A1 Jan. 18, 2018

(51) Int. Cl.

| | |
|---|---|
| ***E21B 34/08*** | (2006.01) |
| ***E21B 34/10*** | (2006.01) |
| ***E21B 34/06*** | (2006.01) |
| *E21B 34/00* | (2006.01) |

(52) U.S. Cl.

CPC ..... *E21B 34/10* (2013.01); *E21B 34/06* (2013.01); *E21B 2034/005* (2013.01)

(58) Field of Classification Search

CPC ..... E21B 34/10; E21B 2034/005; E21B 34/06

USPC ..... 137/527, 527.6

See application file for complete search history.

(56) References Cited

U.S. PATENT DOCUMENTS

| | | | | |
|---|---|---|---|---|
| 4,161,219 | A | 7/1979 | Pringle | |
| 4,407,325 | A * | 10/1983 | Cherniak | F16K 15/033 137/514 |
| 4,660,646 | A | 4/1987 | Blizzard | |
| 6,003,605 | A * | 12/1999 | Dickson | E21B 34/10 166/324 |
| 6,328,062 | B1 | 12/2001 | Williams et al. | |
| 7,798,235 | B2 * | 9/2010 | Mondelli | E21B 34/10 137/527 |
| 2009/0266555 | A1 | 10/2009 | May et al. | |
| 2010/0006295 | A1 | 1/2010 | Goughnour et al. | |
| 2010/0139923 | A1 | 6/2010 | Biddick | |

* cited by examiner

*Primary Examiner* — P. Macade Nichols

(57) ABSTRACT

A device in accordance to an embodiment includes a tubular housing having an inside diameter defining an axial bore, a top surface and an outer surface, a groove formed along the outer surface below the top surface, a flapper pivotally connected with the housing and pivotal between an open position to allow flow through the bore and a closed position to block flow through the bore and a torsion spring having a spring diameter and disposed in the groove and in connection with the flapper to bias the flapper to one of the open and the closed position. The torsion spring may be nested in a C-shaped groove.

20 Claims, 3 Drawing Sheets

NESTED FLAPPER SPRING

BACKGROUND

This section provides background information to facilitate a better understanding of the various aspects of the disclosure. It should be understood that the statements in this section of this document are to be read in this light, and not as admissions of prior art.

The present disclosure relates generally to wellbore operations and equipment and more specifically to actuation devices for downhole tools (e.g., subsurface tools, wellbore tools) and methods of operation.

Hydrocarbon fluids such as oil and natural gas are produced from subterranean geologic formations, referred to as reservoirs, by drilling wells that penetrate the hydrocarbon-bearing formations. Once a wellbore is drilled, various forms of well completion components may be installed in order to control and enhance the efficiency of producing fluids from the reservoir and/or injecting fluid into the reservoir and/or other geological formations penetrated by the wellbore. In some wells, for example, valves are actuated between open and closed states to compensate or balance fluid flow across multiple zones in the wellbore. In other wells, an isolation valve may be actuated to a closed position to shut in or suspend a well for a period of time and then opened when desired. Often a well will include a subsurface valve to prevent or limit the flow of fluids in an undesired direction.

SUMMARY

A device in accordance to an embodiment includes a tubular housing having an inside diameter defining an axial bore, a top surface and an outer surface, a groove formed along the outer surface below the top surface, a flapper pivotally connected with the housing and pivotal between an open position to allow flow through the bore and a closed position to block flow through the bore and a torsion spring having a spring diameter and disposed in the groove and in connection with the flapper to bias the flapper to one of the open and the closed position. In some embodiments the groove, or at least a portion of the groove, is substantially C-shaped having a slot along the outer surface with a diameter less than the spring diameter. The torsion spring may have a first tab in contact with the flapper, for example, extending through an opening in communication with the bore and the groove.

In accordance to an embodiment a valve, such as a subsurface safety valve, includes a tubular housing having an inside diameter defining an axial bore, a top surface and an outer surface, a groove formed along the outer surface below the top surface, a flapper pivotally connected with the housing and pivotal between an open position to allow flow through the bore and a closed position to block flow through the bore and a torsion spring having a spring diameter and disposed in the groove and in connection with the flapper to bias the flapper to one of the open and the closed position. The groove extending circumferentially from a first end to a second end and includes a loading section and a holding section, the loading section extending from the first end to an inlet to the holding section, the loading section has an opening at the surface at least as large as the spring diameter. The holding section extends from the inlet to the second end, wherein the holding section is substantially C-shaped having a slot along the outer surface with a diameter less than the spring diameter.

A method according to aspects of the disclosure includes connecting a torsion spring with a tubular housing and a flapper to bias the flapper into one of an open and a closed position, the housing having an inside diameter defining an axial bore, a top surface and an outer surface, the flapper connected with the housing and pivotal between the open position to allow flow through the bore and the closed position to block flow through the bore, the connecting includes positioning the torsion spring having a spring diameter in a groove formed along the outer surface below the top surface and placing a first tab of the torsion spring in contact with the flapper.

A well system according to aspects of the disclosure includes a valve disposed with a tubular string and deployed downhole in a wellbore, the valve including a tubular housing having an inside diameter defining an axial bore, a top surface and an outer surface, a groove formed along the outer surface below the top surface, a flapper pivotally connected with the housing and pivotal between an open position to allow flow through the bore and a closed position to block flow through the bore and a torsion spring having a spring diameter and disposed in the groove and in connection with the flapper to bias the flapper to one of the open and the closed position.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
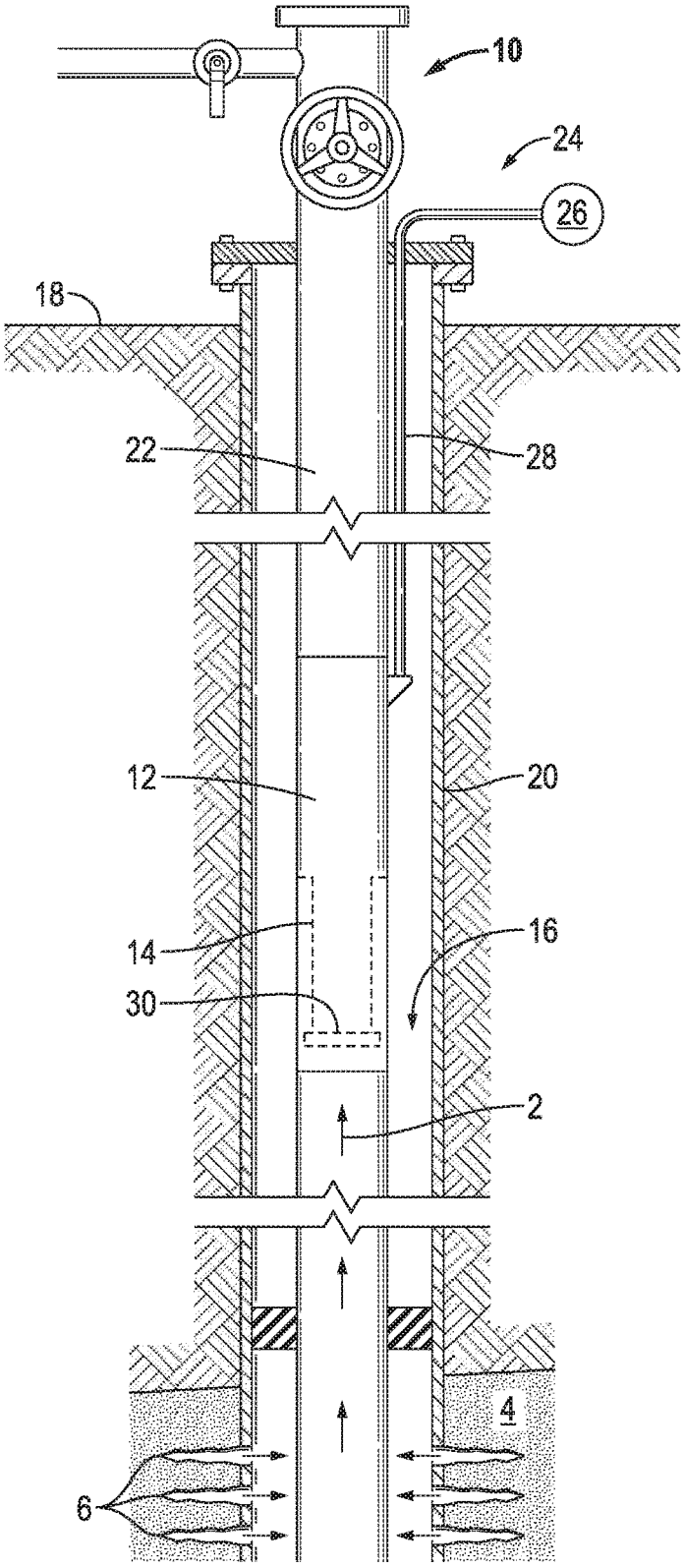
FIG. 1 a schematic of a well system incorporating an embodiment of a downhole valve incorporating a nested torsion spring to bias the valve closure member according to one or more aspects of the disclosure.
Figure 2:
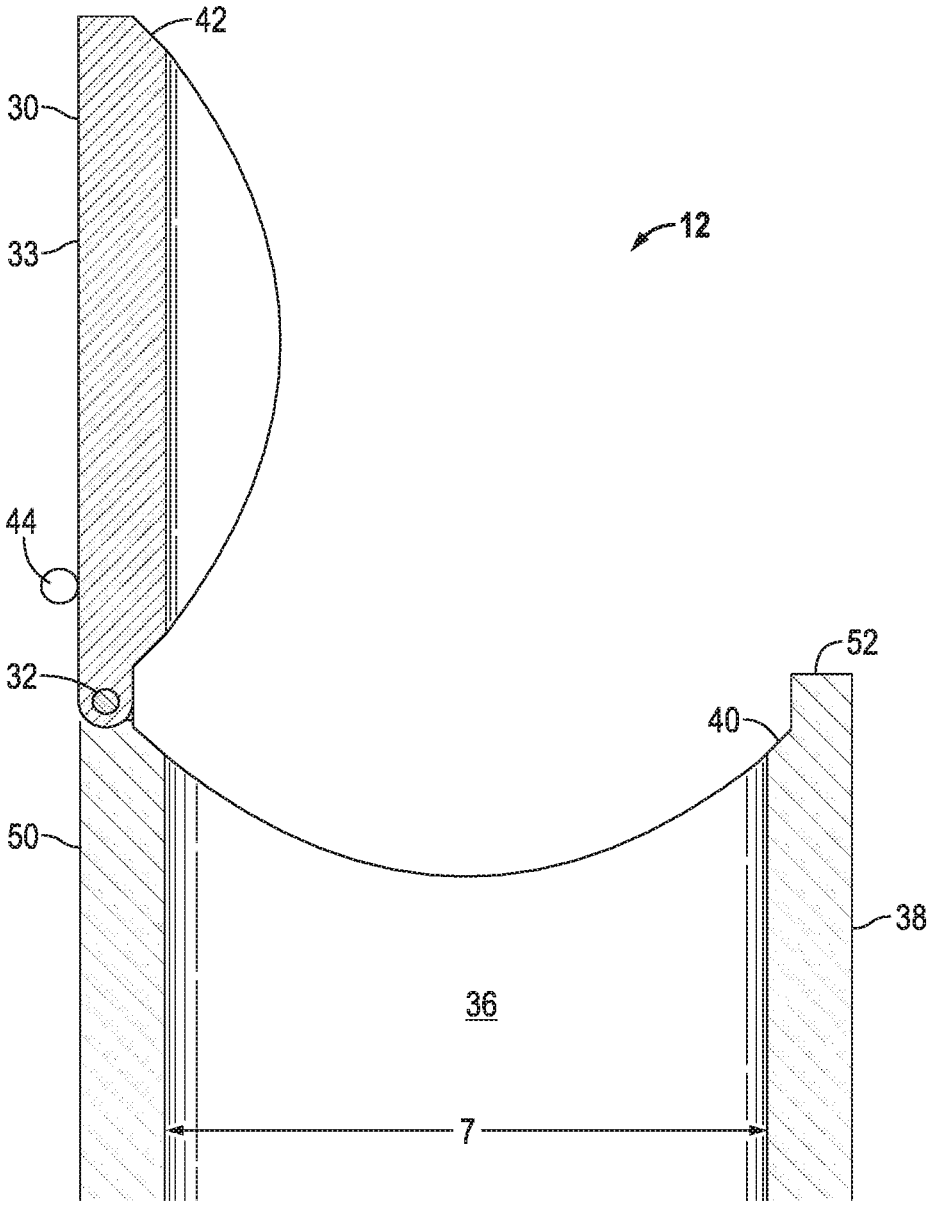
FIG. 2 is a sectional view illustrating a valve according to one or more aspects of the disclosure.
Figure 3:
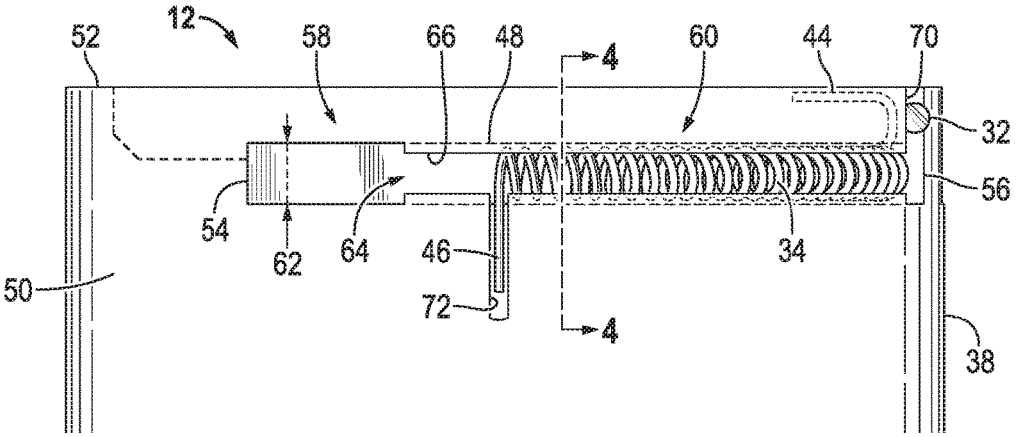
FIG. 3 is a side view of a device according to one or more aspects of the disclosure.
Figure 4:
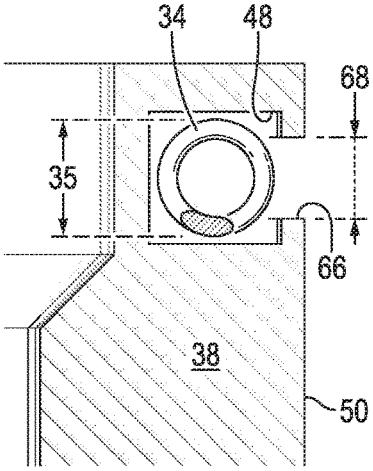
FIG. 4 is sectional view of a nested torsion spring according to one or more aspects of the disclosure along the line 4-4 in FIG. 3.
Figure 5:
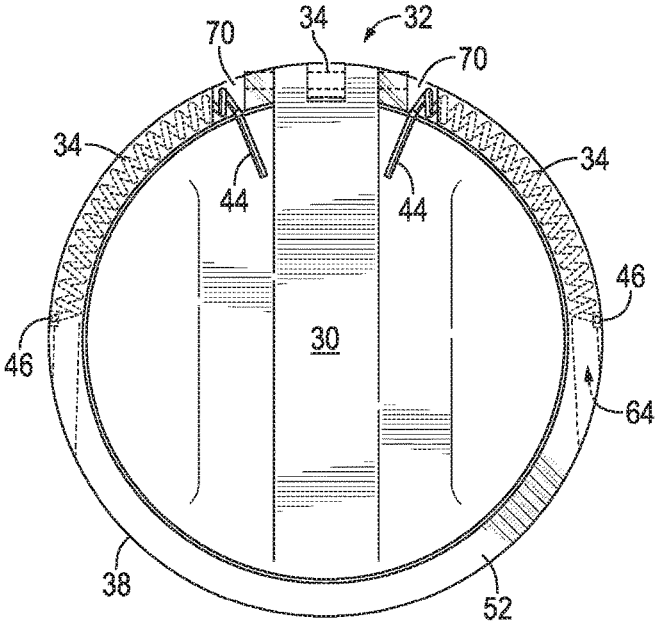
FIG. 5 is an end view illustrating a valve according to aspects of the disclosure in a closed position.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element may be utilized to more clearly describe some elements. Commonly, these terms relate to a reference point such as the surface from which drilling operations are initiated.

Subsurface valves are commonly actuated to a first position (e.g., open) by the application of hydraulic pressure, for example from the surface, and biased to the second position (e.g., closed) by a biasing mechanism (stored energy assembly), such as an enclosed pressurized fluid chamber or a mechanical spring. The fluidic pressure may be applied to a piston and cylinder assembly, for example, that acts against the biasing force of the biasing mechanism to open and hold the valve opened. The biasing force acts on the piston to move it to a position allowing the closure member to move to the closed position when the actuating fluid pressure is reduced below a certain value. Examples of some subsurface valves are disclosed in U.S. Pat. Nos. 4,161,219 and 4,660,646 and U.S. Patent Application Publications 2009/0266555, 2010/0006295 and 2010/0139923, which are all incorporated herein by reference.

FIG. 1 illustrates an embodiment of a downhole device 12 having a flapper 30 according to one or more aspects of the present disclosure. Depicted well system 10 includes a wellbore 16 extending from a surface 18 and lined with casing 20. A tubular string 22 is disposed in wellbore 16. Downhole tool 12 is depicted in FIG. 1 as non-limiting embodiment of a subsurface flow control device (e.g., valve) connected within tubular string 22 for selectively controlling fluid flow through the tubular device 12 and tubular string 22. For example, the valve 12 may be used to block the flow of reservoir fluid 2 through tubular string 22 to the surface when fluid 2 flows from formation 4 through tunnels 6 and into wellbore 16 and tubular string 22 under a greater pressure than desired.

Depicted valve 12 is operated in this example to an open position in response to a signal (e.g., electric signal, fluidic signal, electro-fluidic signal, mechanical signal) provided via control system 24. Depicted control system 24 includes a power source 26 operationally connected to actuator apparatus 14 to operate a flapper 30 (i.e., closure member) from the one position to another position. In FIG. 1, the flapper 30 is in a closed position blocking fluid flow through the bore of the tubular string 22. In the non-limiting embodiment depicted in FIG. 1, control system 24 is a fluidic (e.g., hydraulic) system in which fluidic pressure 26 is provided through control line 28 to an actuator apparatus 14 (e.g., flow tube) which applies an operational force that moves the actuator apparatus in a first direction engaging and actuating flapper 30 to an open position allowing fluid in tubular string 22 to flow across flapper 30. Hydraulic pressure is maintained above a certain level to hold the flapper 30 in the open position. To actuate subsurface valve 12 to the closed position, as shown in FIG. 1, the hydraulic pressure via control line 28 is reduced below a certain level, i.e., the level of the force that biases the biases the flapper 30 to the closed position.

FIGS. 1-5 illustrate embodiments of a device such as a valve or other downhole tool, generally denoted by the numeral 12, incorporating flapper 30 that is biased by a torsional spring 34 according to aspects of the disclosure.

Device 12 has an inside diameter 7 defining an axial bore 36 through a housing 38 (e.g., hard seat) having a hard sealing surface 40, a flapper 30 is pivotally coupled to the housing to move between an open position and a closed position. By coupled, it is understood that flapper 30 may be directly coupled to housing 38 or indirectly coupled by an intermediate member. Flapper 30 is depicted pivotally connected by a hinge 32, for example pivot pin. Hard sealing surface 40 is cooperative with flapper sealing surface 42 to provide a seal when flapper 30 is pivoted to the closed position. The hard sealing surface may be located below the top surface of the housing. The device 12 includes a torsion spring 34 operationally connected with the housing 38 and the flapper 30 to bias the flapper to the closed position. Torsion spring 34 may be operationally connected with the housing and the flapper 30 without the use of alignment rods.

The devices 12 may include one or more torsions springs. For example, two torsion springs 34 may be mounted on opposite sides of the hinge 32. The depicted torsion spring 34 has a diameter 35 and includes a first tab 44 and a second tab 46. The torsion spring 34 is held in a fixed connection with the housing 38 and relative to the flapper 30 with the first tab 44 in contact with the flapper 30 and the second tab 46 in contact with the housing 38. When the flapper is moved in a first direction, for example downward in FIG. 1, to the open position the first tab 44 is also moved in the first direction storing torsional force in torsion spring 34.

Torsion spring 34 is connected with the housing 38 in a manner that eliminates the use of alignment rods that are disposed inside the coils of the torsion spring. In the depicted examples the torsion springs 34 are connected with the housing 38 by being located in a groove 48 formed in the outer surface 50 of the housing. The groove 48 may be oriented to be in-plane or out of plane with the closed position of the flapper 30.

The groove is located axially below a top surface 52 of the housing. The groove 48 extends circumferentially from a first end 54 to a second end 56 and has an inside diameter 62 sized to dispose the torsion spring. The groove 48 includes a loading section 58 and a holding section 60. The loading section 58 is open at the surface 50 for example the full groove diameter 62 and extends from the first end 54 to an inlet 64 into the holding section 60. The holding section 60 is C-shaped having a surface opening 66 with a diameter 68 which is less than the diameter 35 of the torsion spring and less than the diameter 62 of the groove 48.

An opening 70 is located in the housing 38 between the groove 48 proximate to the second end 56 and the axial bore 36 proximate to the hinge 32. A recess 72 may be formed in the outer surface 50 extending away from the groove 48 and in connection with the groove in the holding section 60.

After preparing the flapper sealing surface and the hard sealing surface the flapper may be pivotally connected to the housing 38. The torsion spring 34 is inserted, leading with the first tab 44, through loading section 58 and into groove 48 of the holding section 60 with the first tab 44 extending out through the surface opening 66. The torsion spring is loaded into the holding section 60 until the second tab 46 is inside of the holding section. The torsion spring may then be rotated positioning the first tab 44 through opening 70 and into contact with the flapper 30, for example the top surface 33, and the second tab 46 is located for example in recess 72.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A device, comprising:

a tubular housing having an inside diameter defining an axial bore, a top surface and an outer surface;

a groove formed along the outer surface below the top surface;

a flapper connected with the housing and pivotal between an open position to allow flow through the bore and a closed position to block flow through the bore; and a torsion spring having a spring diameter and disposed in the groove and in connection with the flapper to bias the flapper to one of the open and the closed position, wherein the torsion spring is connected with the tubular housing and the flapper without using alignment rods.

2. The device of claim 1, wherein the groove is substantially C-shaped having a slot along the outer surface with a diameter less than the spring diameter.

3. The device of claim 1, wherein the torsion spring has a first tab in contact with the flapper and a second tab in contact with the housing.

4. The device of claim 1, wherein the torsion spring has a first tab in contact with the flapper and a second tab positioned in a recess on the outer surface of the housing.

5. The device of claim 1, wherein the groove is substantially C-shaped having a slot along the outer surface with a diameter less than the spring diameter, and wherein the torsion spring comprises a first tab in contact with the flapper and a second tab in contact with the housing.

6. The device of claim 1, wherein the groove is substantially C-shaped having a slot along the outer surface with a diameter less than the spring diameter, and wherein the torsion spring comprises a first tab in contact with the flapper and a second tab positioned in a recess on the outer surface of the housing.

7. The device of claim 1, wherein the groove extends circumferentially from a first end to a second end, an opening formed through the housing between the axial bore and the groove proximate to the second end, and wherein the torsion spring comprises a first tab extending through the opening and in contact with the flapper.

8. The device of claim 7, wherein the groove is substantially C-shaped having a slot along the outer surface with a diameter less than the spring diameter.

9. The device of claim 1, wherein the groove extends circumferentially from a first end to a second end and includes a loading section and a holding section, wherein the loading section extends from the first end to an inlet into the holding section, the loading section having an opening at a surface at least as large as the spring diameter, wherein the holding section extends from the inlet to the second end, and wherein the holding section is substantially C-shaped having a slot along the outer surface with a diameter less than the spring diameter.

10. The device of claim 9, further comprising an opening in communication with the axial bore and the groove proximate to the second end; and a first tab of the torsion spring extending through the opening and in contact with the flapper.

11. The device of claim 9, further comprising an opening in communication with the axial bore and the groove proximate to the second end;

a first tab of the torsion spring extending through the opening and in contact with the flapper; and a second tab of the torsion spring extending through the slot in the groove and in contact with the outer surface of the housing.

12. The device of claim 11, wherein the second tab is located in a recess on the outer surface.

13. A method, comprising:

connecting a torsion spring with a tubular housing and a flapper without using alignment rods to bias the flapper into one of an open and a closed position, the housing having an inside diameter defining an axial bore, a top surface and an outer surface and the flapper connected with the housing and pivotal between the open position to allow flow through the bore and the closed position to block flow through the bore, wherein the connecting comprises:

positioning the torsion spring having a spring diameter in a groove formed along the outer surface below the top surface and placing a first tab of the torsion spring in contact with the flapper.

14. The method of claim 13, wherein the groove is substantially C-shaped having a slot along the outer surface with a diameter less than the spring diameter.

15. The method of claim 13, wherein the groove extends circumferentially from a first end to a second end and includes a loading section and a holding section, wherein the loading section extends from the first end to an inlet into the holding section, the loading section having an opening at a surface at least as large as the spring diameter, wherein the holding section extends from the inlet to the second end, and wherein the holding section is substantially C-shaped having a slot along the outer surface with a diameter less than the spring diameter.

16. The method of claim 13, further comprising:

an opening in communication with the axial bore and the groove proximate to the second end;

a first tab of the torsion spring extending through the opening and in contact with the flapper; and a second tab of the torsion spring extending through the slot in the groove and in contact with the outer surface of the housing.

17. A well system, the system comprising:

a valve disposed with a tubular string and deployed downhole in a wellbore, the valve comprising:

a tubular housing having an inside diameter defining an axial bore, a top surface and an outer surface;

a groove formed along the outer surface below the top surface;

a flapper connected with the housing and pivotal between an open position to allow flow through the bore and a closed position to block flow through the bore; and a torsion spring having a spring diameter and disposed in the groove and in connection with the flapper to bias the flapper to one of the open and the closed position, wherein the torsion spring is connected with the tubular housing and the flapper without using alignment rods.

18. The system of claim 17, wherein the groove is substantially C-shaped having a slot along the outer surface with a diameter less than the spring diameter.

19. The system of claim 17, wherein the groove extends circumferentially from a first end to a second end and includes a loading section and a holding section, wherein the loading section extends from the first end to an inlet into the holding section, the loading section having an opening at the outer surface at least as large as the spring diameter, wherein the holding section extends from the inlet to the second end, and wherein the holding section is substantially C-shaped having a slot along the outer surface with a diameter less than the spring diameter.

20. The system of claim 17, further comprising:

an opening in communication with the axial bore and the groove proximate to the second end;

a first tab of the torsion spring extending through the opening and in contact with the flapper; and a second tab of the torsion spring extending through the slot in the groove and in contact with the outer surface of the housing.

* * * * *